United States Patent [19]

Roszel

[11] 4,455,546

[45] Jun. 19, 1984

[54] VARIABLE RESISTOR AND SWITCH ASSEMBLY HAVING SEPARATE SLIDERS

[75] Inventor: Lynn Roszel, Richardson, Tex.

[73] Assignee: Prescolite, a Div. of U.S. Indus., San Leandro, Calif.

[21] Appl. No.: 470,296

[22] Filed: Feb. 28, 1983

[51] Int. Cl.[3] ..... H01C 10/00

[52] U.S. Cl. ..... 338/179; 200/313; 200/330; 338/198; 338/200

[58] Field of Search ..... 338/172, 198, 200, 179, 338/119, 196, 176; 200/153 LA, 330, 329, 313, 18

[56] References Cited

U.S. PATENT DOCUMENTS

| | | | |
|---|---|---|---|
| 2,515,932 | 7/1950 | Stang et al. | 200/330 |
| 3,668,597 | 6/1972 | Nomura | 338/200 |
| 3,746,923 | 7/1973 | Spira et al. | 338/179 |
| 4,042,903 | 8/1977 | Finegan | 338/198 |
| 4,090,167 | 5/1978 | Walker et al. | 338/198 |
| 4,114,000 | 9/1978 | Feder | 200/153 LA |
| 4,357,592 | 11/1982 | Okuya | 338/176 |

*Primary Examiner*—John W. Shepperd
*Attorney, Agent, or Firm*—Bielen and Peterson

[57] ABSTRACT

A switch for controlling the current to a load combining an ON-OFF switch in series with a variable resistor. Switch has a housing which includes an actuator guided along a dimension of the housing. An opening through the actuator permits a portion of the regulator switch to pass through the actuator for operation. The actuator also includes a cam surface for operating the ON-OFF switch.

8 Claims, 6 Drawing Figures

VARIABLE RESISTOR AND SWITCH ASSEMBLY HAVING SEPARATE SLIDERS

BACKGROUND OF THE INVENTION

The present invention relates to a novel switch device which may be used to control an ON-OFF switch as well as a voltage regulating switch.

The standard dimmer switch for an electrical light has included a rotary element useable in conjunction with a push or pull mechanism. The rotary element generally controls the dimming of the lamp while the push-pull mechanism turns the lamp to either the on or off position.

A later develpment found in the U.S. Pat. No. 3,746,923, describe a dimmer having a linear control. The linear control permitted the user to more easily control the lighting, in that full range of lighting levels may be attained by simple up or down motion. In addition, the on-off function was intergrated into the path of the travel of the linear element.

The combining of the linear dimming function and the on-off function in a single control, although satisfactory for a compact relatively low power rated dimmer, is not applicable where these functions must be separated. A control switch which permits the separation of the on-off function from the voltage regulating portion of the switch yet maintains the proximity of these two elements in a single unit would be an advance in the electrical art.

SUMMARY OF THE INVENTION

In accordance with the present invention a novel switch for controlling the current to a load which combines an on-off switch in series with a variable resistor is provided.

The switch of the present invention includes a housing which has a guide along a dimension thereof. The guide may take the form of a groove or series of grooves which extend along a dimension of the housing.

An actuator is also provided in the present invention. The actuator moves along the dimension of the housing which generally coincides with the dimension of the guide within the housing. The actuator further includes an opening therethrough for permitting a portion of the variable resistor to pass therethrough. This opening may be an elongated opening to permit linear movement of the variable resistor portion. In addition, the actuator may be constructed with a cam surface for contacting a portion of the on-off switch which results in operation of the same.

A cover may enclose the actuator in relation to the housing. The cover also has an opening therethrough to permit movement of the portion of the variable resistor which also passes through the actuator opening. In addition a slider may be connected to this portion of the variable resistor and be movable in relation to the cover. The user gains access to the slider on the exterior of the cover for facilitating the working of the switch.

The switch on the present invention also includes means for transmitting light along the dimension of the actuator. Source of light positions adjacent the actuator, preferably within the cavity in the actuator. Cavity would be formed to permit movement of the actuator without contacting the source of light. Moreover the actuator is formed to extend outside the cover enclosed housing to permit the user to manipulate the same. The light transmitted along the dimension of the actuator would appear on this portion or leg extending beyond the confines of the cover.

It may be apparent that a novel and useful switch mechanism which is especially useful in regulating an incandescent lamp has been provided.

It is an object of the present invention to provide a switch for controlling the current to a load which has an on-off switch and a variable resistor in series within a unit such that the switch devices are separately and easily operable by the user.

It is another object of the present invention to provide a switch for controlling the current to a load which includes an on-off switch which has a leg that is lighted from within the main housing of the switch unit.

It is another object of the present invention to provide a switch for controlling the current to a load which is capable of handling larger electrical power than prior switches.

It is another object of the present invention to provide a switch for controlling the current to a load which is especially useful in controlling the on-off function as well as the dimming function of an incandescent lamp.

The invention possesses other objects and advantages especially as concerns particular characteristics and features thereof which will become apparent as the specification continues.

For a better understanding of the invention reference is made to the following detailed description which should be referenced to the hereinabove described drawings.

DESCRIPTION OF THE PREFERRED EMBODIMENTS

Figure 1:
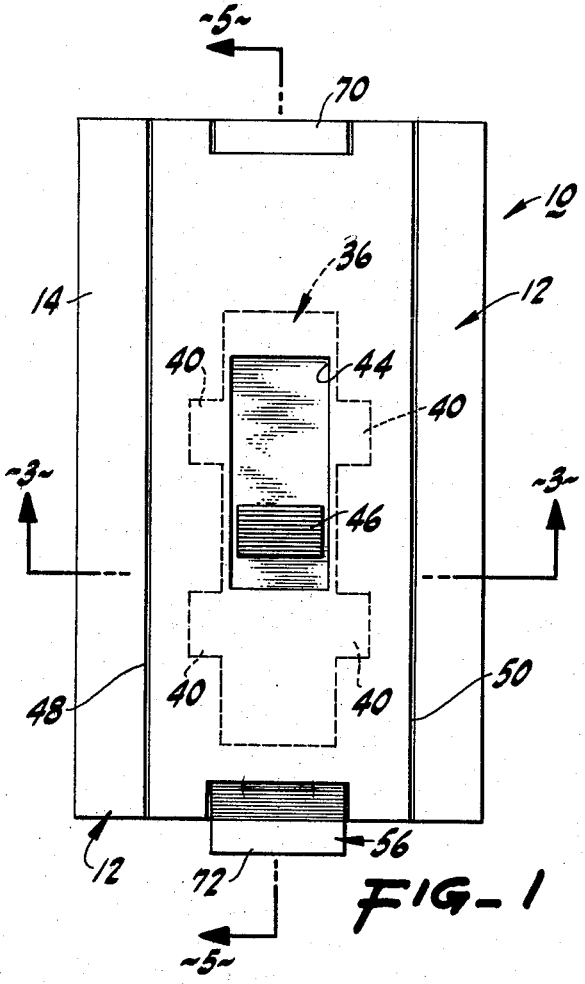
FIG. 1 is a top plan view of the device.
Figure 3:
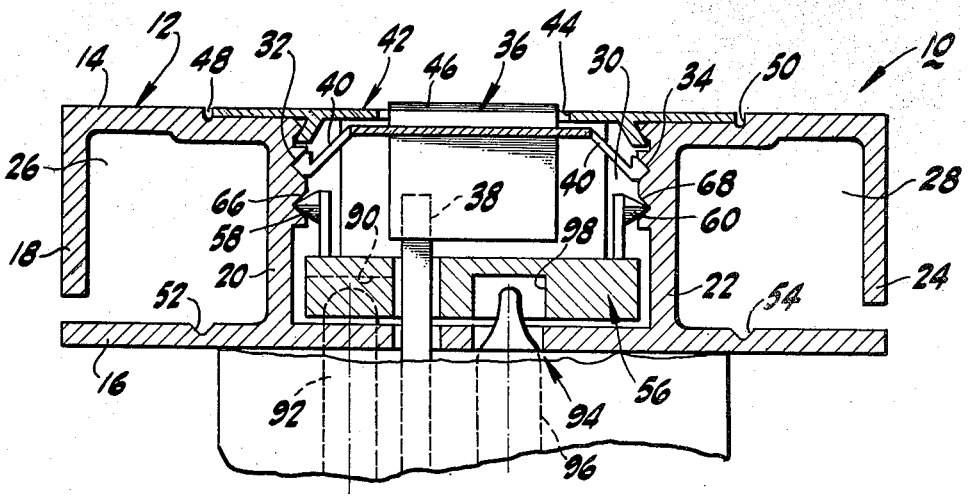
FIG. 3 is a view taken along line 3—3 of FIG. 1.

Various aspects of the present invention will evolve from the following detailed description of the preferred embodiments thereof which should be taken in conjunction with the hereinabove drawings. The invention as a whole is represented in the drawings by reference character 10. The switch device 10 includes as one of its elements a housing 12, FIGS. 1 and 3. With reference to FIG. 3 it may be seen that housing 12 includes a front plate 14 and a back plate 16. Fins 18, 20, 22, and 24 are formed between front and back plates 14 and 16. Chimneys 26 and 28 between fins 18 and 20 and 22 and 24 respectively permit the dissipation of heat from the switch device 10. Space 30 includes grooves 32 and 34 which serve as guides for a slider 36. Element 38 connected to slider 36 represents a portion of a variable resistor which generally serves as a dimmer for an incandescent lamp or other load (not shown). Element 38 moves generally in a linear manner. With reference to FIG. 1 it may be seen that slider 36 has a series of tabs of legs 40 which fit within grooves 32 and 34. A cover 42 having an opening 44 exposes a portion of slider 36 to the user. A knurled pedestal 46 permits fingertip control of slider 36.

Figure 2:
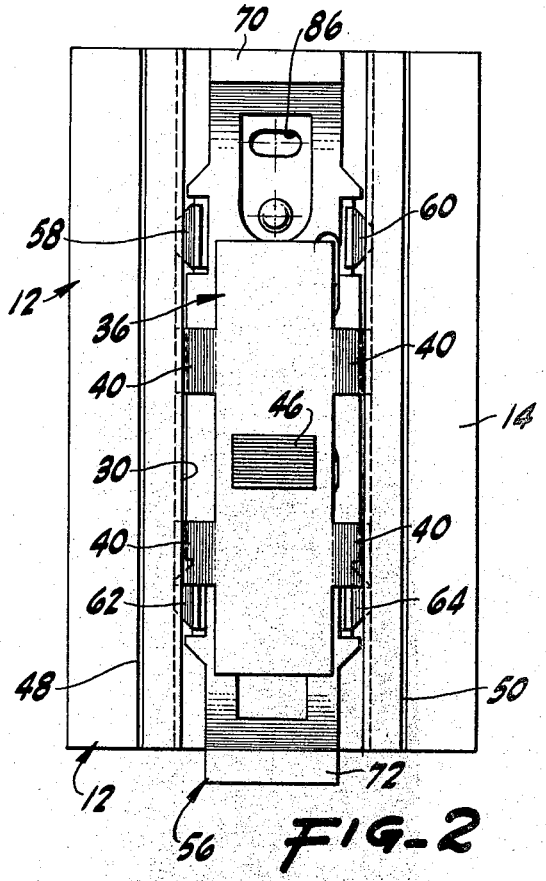
FIG. 2 is a top plan view of the device with a top plate removed.

Turning to FIG. 2, it should be noted that cover 42 has been removed from opening 30 revealing slider 36. Scored crevices 48 and 50, FIG. 2, as well as grooves 52 and 54 on plate 16, FIG. 13, permit the breaking off of a portion of housing 12 such that a plurality of such housing may be placed side by side to operate multiple switches. This "ganging" technique is well known in the art.

Figure 4:
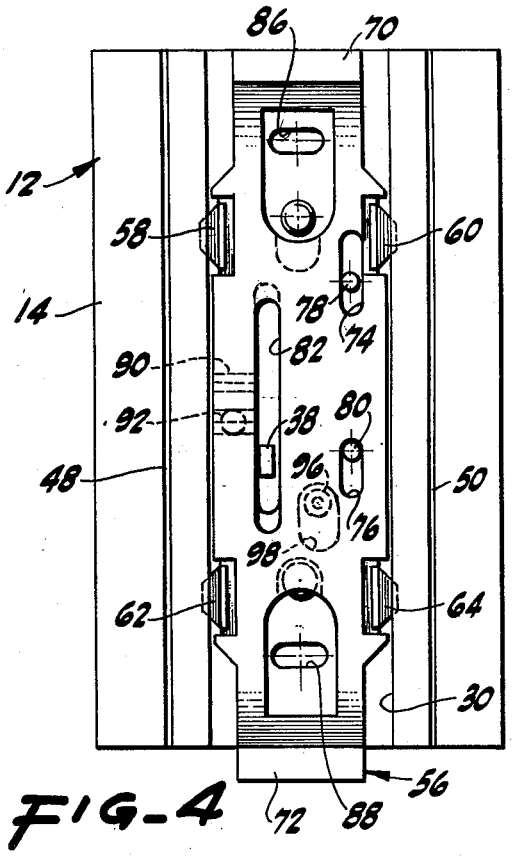
FIG. 4 is a top plan view of the device with two plates removed therefrom.
Figure 6:
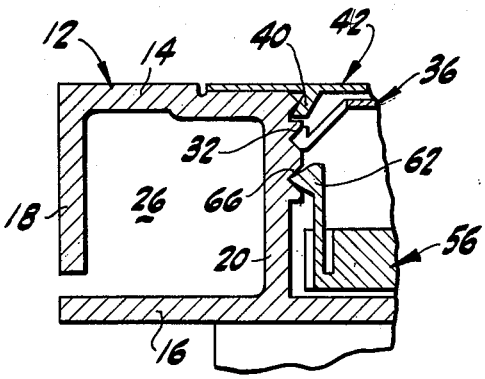
FIG. 6 is a view taken along line 6—6 of FIG. 5.

An actuator 56, FIGS. 2 and 3, but best shown in FIG. 4, is movable along space 30. Appendages 58, 60, 62 and 64 slide in grooves 66 and 68, FIGS. 3 and 6. With reference to FIG. 4 it may be seen that actuator 56 includes two legs 70 and 72 which makes 10 beyond the length of housing 12 and cover 42 when it is in place. Slots 74 and 76 includes stops 78 and 80 which serve to limit the travel of the actuator 56 in its travel along grooves 66 and 68 i.e. the long dimension of housing 12. Slot 82 serves as an opening through actuator 56 for linear element 38. It may be apparent that stops 78 and 80 also serve as rivets for any appurtenances which may attach to the back of plate 16. For example, in the element 38 and the potentiometer connected thereto (not shown). Slots 86 and 88 permit the connecting of device 10 to a wall box.

Figure 5:
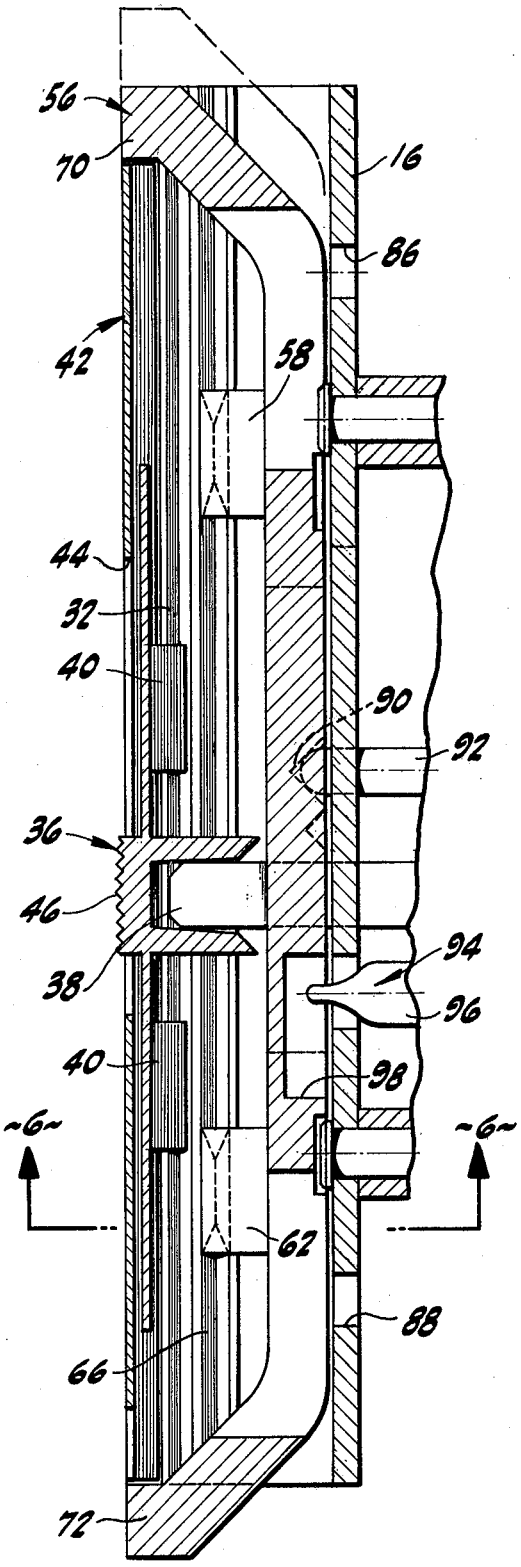
FIG. 5 is a view taken along line 5—5 of FIG. 1.

Actuator 56 also includes cam surface 90 for moving portion 92 of the on-off switch not shown. As may be seen from FIG. 5 cam surface includes two distinctive positions. These positions coincide with the limit of travel of actuator 56 along slots 74 and 76.

Device 10 also embraces means 94 for transmitting light along the lengthwise dimension of acutator 56 i.e. from leg 70 to leg 72. Means 94 may take the form of constructing actuator 56 of material having internal reflectance. In light source 96, FIGS. 4 and 5, fits within a slot 98 such that the travel of actuator 56 will not cause any contact with a light source 96. Thus, with slider 36 and cover 42 in place, leg 70 and 72 will appear illuminated. Thus slot 98, which does not extend through actuator 56 serves as a cavity.

An operation, the device would be in the configuration shown in FIG. 1 where slider 36 and cover 42 are in place. The two legs 70 and 72 of actuator 56 would appear illuminated by the action of means 94 in order that the user may find the same and a dark space. A push upwardly or downwardly on actuator 56 would operate on-off switch 92 via the heretofore described action of cam surface 90. With the on-off switch in the on position the user would then adjust the light level of the lamp (not shown) connected to device 10 by moving slider 36 upwardly or downwardly to the desired end point. Slider 36 would have caused the movement of linear element 38 along slot 82. Thus, the switch of the present invention accomodates an on-off switch as well as a variable resistor in the same unit.

While on the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A switch assembly for controlling the current to a load combining an On-Off switch in series with a variable resistor the improvement comprising:

(a) a housing having a guide along a dimension thereof;

(b) an actuator being moved along said dimension of said housing, said actuator movement being defined by said guide of said housing and means for stopping movement of said actuator, said actuator further including an opening therethrough for permitting a first portion of an element of the variable resistor to pass therethrough and a second portion of the element of the variable resistor to remain accessible on one side of said actuator, said actuator also including a cam surface for contacting a portion of the ON-OFF switch for operation of the same, said opening and said stop means being sized and positioned to permit said operation of said ON-OFF switch.

2. The switch assembly of claim 1 in which at least a portion said actuator includes means for transmitting light along a dimension of said actuator and a source of light place adjacent said actuator.

3. The switch assembly of claim 2 in which said actuator includes a cavity and said source of light extends into said cavity, said cavity being formed to permit movement of said actuator without contacting said source of light.

4. The switch assembly of claim 1 which additionally comprises a cover for enclosing said actuator, said actuator being movable beneath said cover, said cover including an opening therethrough to permit movement of the element of the variable resistor which passes through said actuator opening.

5. The switch assembly of claim 4 which additionally comprises a slider connected to the element of the variable resistor said slide being movable in relation to said cover and being accessible on the exterior of said cover.

6. The switch assembly of claim 5 in which said actuator includes at least one leg which extends beyond said cover.

7. The switch assembly of claim 6 in which at least a portion said actuator includes means for transmitting light along a dimension of said actuator and a source of light place adjacent said actuator.

8. The switch assembly of claim 7 in which said actuator includes a cavity and said source of light extends into said cavity, said cavity being formed to permit movement of said actuator without contacting said source of light.

* * * * *